US005720588A

United States Patent [19]

Graves

[11] Patent Number: 5,720,588

[45] Date of Patent: Feb. 24, 1998

[54] REFUSE CONTAINER LATCH

[76] Inventor: Calvin J. Graves, 537 Iroquois, Carol Stream, Ill. 60188

[21] Appl. No.: 490,307

[22] Filed: Jun. 14, 1995

[51] Int. Cl.[6] ..... B65F 3/02

[52] U.S. Cl. ..... 414/406; 414/421

[58] Field of Search ..... 414/406, 407, 414/408, 421, 425, 546

[56] References Cited

U.S. PATENT DOCUMENTS

| | | | |
|---|---|---|---|
| 2,951,602 | 9/1960 | Walden et al. . | |
| 3,012,684 | 12/1961 | Sexton et al. . | |
| 3,024,928 | 3/1962 | Freaney | 414/425 X |
| 3,032,216 | 5/1962 | McCarthy . | |
| 3,147,870 | 9/1964 | Urban et al. | 414/408 X |
| 3,702,662 | 11/1972 | Davieau . | |
| 3,747,785 | 7/1973 | Dahlin | 414/406 X |
| 3,804,277 | 4/1974 | Brown et al. . | |
| 3,931,901 | 1/1976 | Jones . | |
| 4,090,626 | 5/1978 | Ebeling et al. | 414/407 |
| 4,687,405 | 8/1987 | Olney | 414/408 |
| 4,811,660 | 3/1989 | Robbins | 100/229 A |
| 4,960,355 | 10/1990 | Worthington | 414/408 |
| 5,006,030 | 4/1991 | Smith et al. | 414/408 X |
| 5,062,759 | 11/1991 | Pieperhoff | 414/408 |
| 5,094,582 | 3/1992 | Molzhon | 414/406 |
| 5,425,613 | 6/1995 | Osborn | 414/406 X |

FOREIGN PATENT DOCUMENTS

| | | | |
|---|---|---|---|
| 2228248 | 8/1990 | United Kingdom | 414/408 |

*Primary Examiner*—James W. Keenan

*Attorney, Agent, or Firm*—Wood, Phillips, VanSanten, Clark & Mortimer

[57] ABSTRACT

A refuse container latch for use with large refuse containers or dumpsters having outwardly extending protrusions. Preferably, the latch comprises a pivotally mounted latch plate, a substantially vertical support plate, and a power supply, the power supply preferably comprising a hydraulic piston-cylinder arrangement. The hydraulic piston-cylinder arrangement is attached to the latch plate, and rotates the latch plate from an open position to a closed position where the latch plate is substantially vertical and substantially parallel to the support plate. In the closed position, the protrusions are confined to a channel defined by the latch plate and the support plate.

4 Claims, 3 Drawing Sheets

REFUSE CONTAINER LATCH

BACKGROUND OF THE INVENTION

The present invention relates to refuse containers and refuse collection vehicles. In particular, the present invention relates to a latch for holding a refuse container to a refuse collection vehicle while refuse is being transferred from the refuse container to the refuse collection vehicle.

Refuse containers come in many different shapes and sizes. Among the largest refuse containers are the dumpsters, which are typically two cubic yards and larger, and are commonly used in commercial and high-density residential settings. Examples of such refuse containers can be found in U.S. Pat. No. 4,687,405 to Olney (FIG. 5), U.S. Pat. No. 3,032,216 to McCarthy (FIG. 1), and U.S. Pat. No. 4,811,660 to Robbins.

Refuse contained in a dumpster-type refuse container is usually transferred to a refuse collection vehicle by placing an upper edge of one of the sides of the container against a surface, or sill, on the collection vehicle and then pivoting the container about the edge-sill interface, or pivot axis. When the container reaches a sufficiently large angle with respect to the horizontal plane, the refuse within the container will slide out of the container and into a collection chamber carried on the collection vehicle. The rotation of the container about the pivot axis can be accomplished by a number of methods, known to those skilled in the art, including the use of a tipper bar or a hoist.

Because of the size and weight of the dumpster-type refuse container and its contents, in order to protect the vehicle operators and to ensure that the container does not turn over during the transfer, dumpster-type refuse containers are commonly attached to the collection vehicle by some form of locking mechanism. An illustration of one such locking mechanism for use with a refuse container having a pivot rod with protruding end portions can be found in U.S. Pat. No. 3,032,216 to McCarthy. The locking mechanism, as illustrated in FIG. 3, comprises a plate, a locking lever, and a latching lever. The locking lever is movable about a pin and cooperates with the plate to provide an enclosed slot between the locking lever and the plate. In operation, the operator will manually position the end portions of the pivot rod into the lower end of the slot. The locking levers and latching lever are then manipulated to lock the end portions of the pivot rod in a position confined within the slot.

This locking mechanism has a number of significant disadvantages. In order to close the locking lever, the refuse container must first be moved so that the ends of the pivot bar are within the slot. Some portion of the initial positioning of the container can be performed through careful placement of the refuse collection vehicle. However, in the end, the final positioning is usually performed by hand by the vehicle operator. As the dumpster-type refuse container can contain several cubic yards of refuse, and may or may not be mounted on wheels, often only minor adjustments can be performed without jeopardizing health and safety of the operators. Consequently, it may be necessary to reposition the refuse collection vehicle a number of times before obtaining a successful closure of the locking mechanism.

Even with successful closure of the locking mechanism, a slight misalignment in the pivot axis of the container can create additional consequences. Misalignment increases the possibility that the forces exerted on the locking mechanism by the end portions of the pivot rod during the transfer process will cause the latch device to open prematurely.

Aside from the safety risks posed to the vehicle operators from the locking mechanism prematurely opening, a considerable amount of additional time and resources is required to correct an overturned refuse container if the locking mechanism fails.

Therefore, attempts have been made to automate the locking mechanism to allow for power-assisted locking of the refuse container to the collection vehicle. U.S. Pat. No. 3,702,662 to Davieau shows an automated locking mechanism comprised of cam shaped plates and hook arms and a refuse container having laterally extending rod members. The hook arms rotate with a central shaft, which shaft is rotated by means of a hydraulic cylinder. As a result of the movement of the hook arms, the laterally extending rod members of the refuse container move upwardly along the edge of the cam plates until the rod members drop into engagement with U-shaped sockets in the cam plates. With further rotation of the shaft, the hook arms slide over the exposed surfaces of the rod members to lock the rod members in the sockets.

The automated locking mechanism, however, also has a number of drawbacks. First, the automated locking mechanism requires that the rod members have sufficient lateral strength to withstand the forces generated in lifting the container and its contents by the ends of the rod members. The automated locking mechanism also requires that the cam plates be accurately manufactured to prevent misalignment and have sufficient strength to withstand the forces generated along the edges of the cam plates during the lifting procedure.

In addition, the automated locking mechanism still requires careful initial positioning of the container with respect to the collection vehicle. In order for the automated locking mechanism to operate properly, the container must be positioned so that the rod members on the container engage the beginning of the flattened portion of the edge of the cam plates. Consequently, the automated mechanism still requires the operators proceed through the same kind of positioning and repositioning described above for the manual locking mechanism.

Therefore, it is an object of the present invention to provide a refuse container latch with power-assisted closure of increased simplicity and safety.

It is another object of the invention to provide a refuse container latch which reduces the amount of operator involvement in the initial positioning of the refuse container with respect to the refuse collection vehicle and which improves operator efficiency.

Further, it is still another object of the invention to provide a refuse container latch of reduced cost and weight.

SUMMARY OF THE INVENTION

The refuse container latch of the present invention is for use with refuse containers having outwardly extending protrusions, such as the ends of a trunnion bar. The latch is comprised of a substantially vertical support surface, a pivotally mounted latch surface and a power supply. Both the substantially vertical support surface and the pivotally mounted latch surface are attached to a refuse collection vehicle. The power supply is also mounted on the refuse collection vehicle and is attached to the latch surface to rotate the latch surface from an open position to a closed position in which the latch surface is substantially vertical and facing the support surface. In the closed position, the support surface and the latch surface define a substantially vertical channel in which the protrusions of the refuse container are confined, and thereby prevented from moving substantially in a horizontal direction, but allowed to move in a vertical direction.

BRIEF DESCRIPTION OF THE DRAWINGS

In describing the preferred embodiment of the present invention, reference is made to the accompanying drawings wherein like parts have like reference numerals, and wherein.

DESCRIPTION OF THE PREFERRED EMBODIMENT

Figure 1:
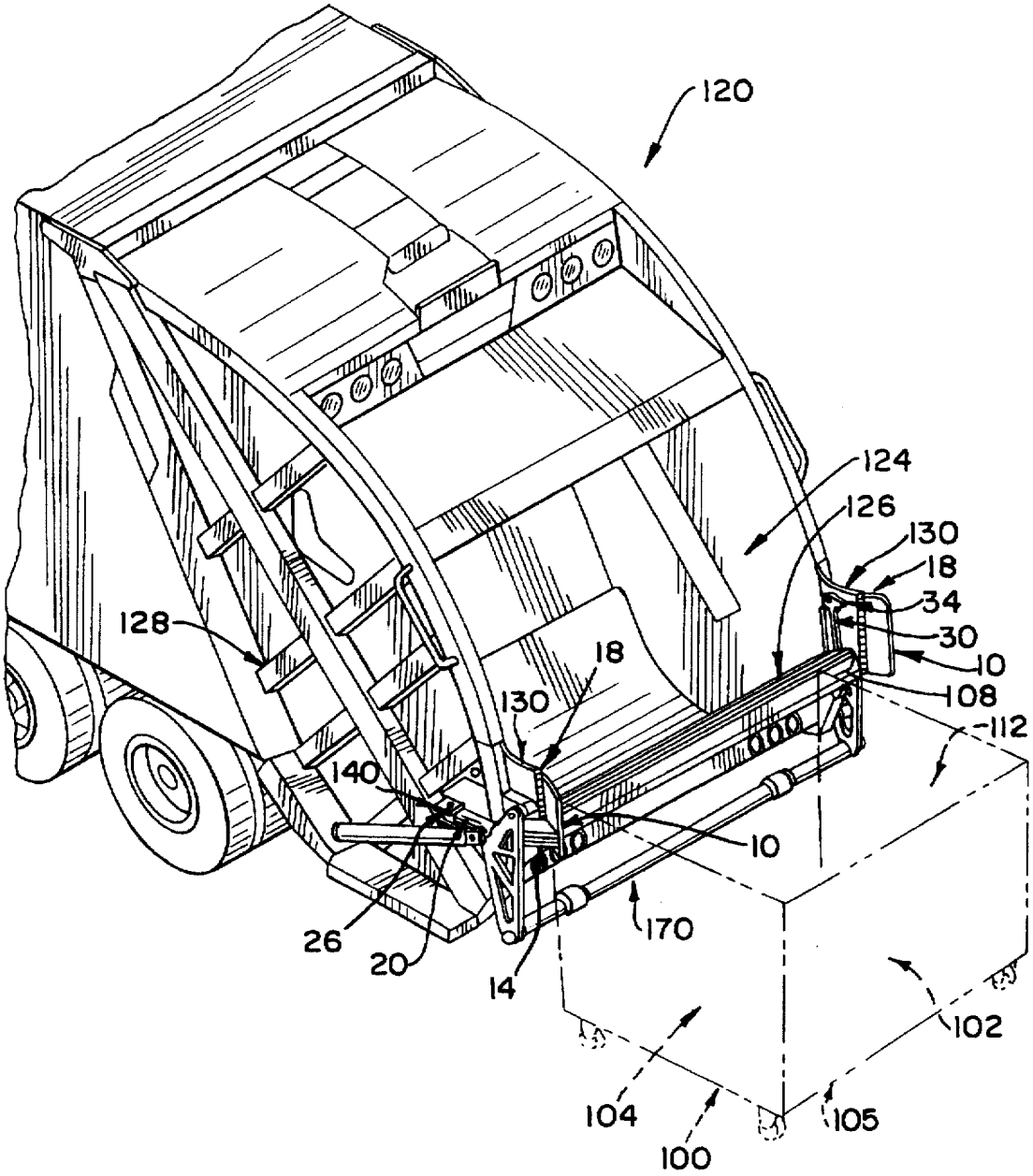
FIG. 1 is a partial perspective view of the rear portion of a refuse collection vehicle showing one embodiment of the present invention in the open position.

Referring to FIG. 1, a refuse container 100 is shown (in phantom line), having two long sides 102, two short sides 104 and a bottom 105. Long and short sides 102, 104 and bottom 105 define a refuse collection chamber 112.

Figure 3:
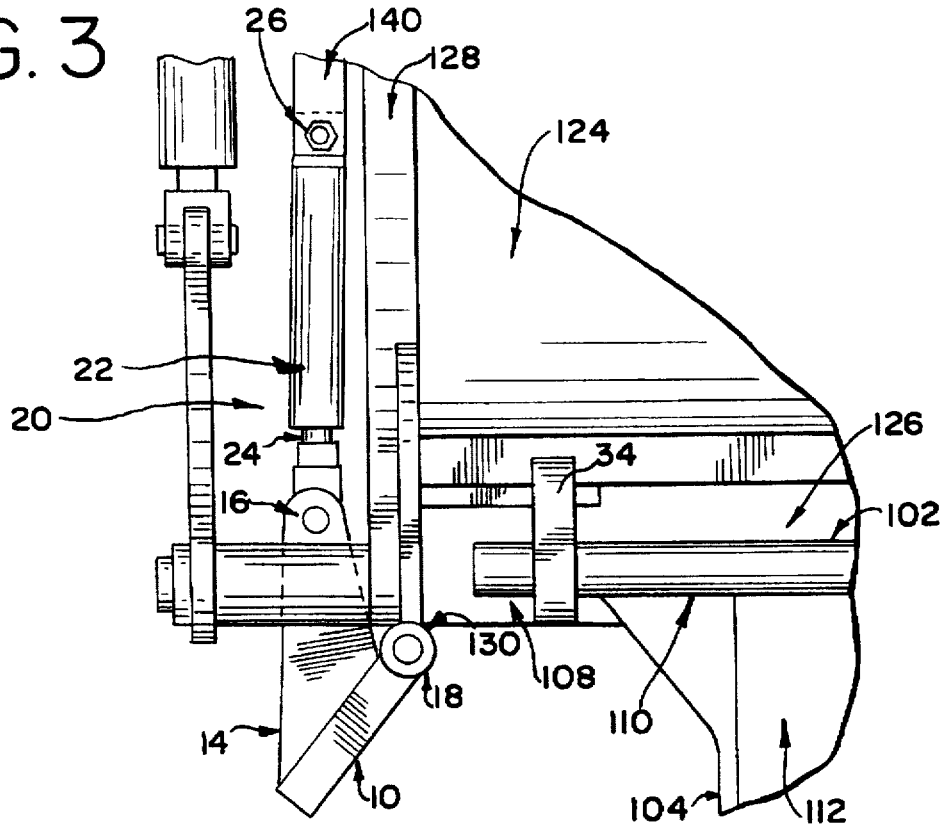
FIG. 3 is a view of the rear portion of the refuse collection vehicle from above, showing the latch in the open position.

Preferably, as shown in FIG. 3, a trunion bar 110 having outwardly extending protrusions 108 is attached along an upper edge of one of long sides 102. However, it is also understood that outwardly extending protrusions 108 may also be attached to short sides 104, by means such as welding, without use of trunion bar 110. It is also understood that trunion bar 110 could be attached along an upper edge of one of short sides 104.

A rear portion of a refuse collection vehicle 120 is also shown in FIG. 1. Refuse collection vehicle 120 has an opening 124 for allowing refuse from container 100 to be transferred to a collection chamber carried on vehicle 120. Along the lower edge of opening 124 is a sill 126.

At each side of opening 124 are mounted the preferred embodiment of a refuse container latch. The latch preferably comprises a latch plate 10 and a support plate 30. In the preferred embodiment, support plate 30 is mounted to vehicle 120 in a substantially vertical plane at the inner edge of sill 126. Latch plate 10 is mounted via vertical hinge 18 to a rearmost edge 130 of side 128 of vehicle 120. Latch plate 10 can rotate about hinge 18 from an open position generally at right angles to support plate 30 to a closed position with latch plate 10 facing and substantially parallel to support plate 30.

While in this preferred embodiment of the invention latch plate 10 is pivotally mounted to vehicle 120 so that latch plate 10 is substantially vertical in the open position, the closed position, and all intermediate positions, latch plate 10 could also be pivotally mounted on or below sill 126. In this embodiment, latch plate 10 would start in a horizontal plane at substantially right angles to support plate 30 before moving to a closed position where latch plate 10 is facing support plate 30 in a substantially vertical plane parallel to support plate 30.

Figure 2:
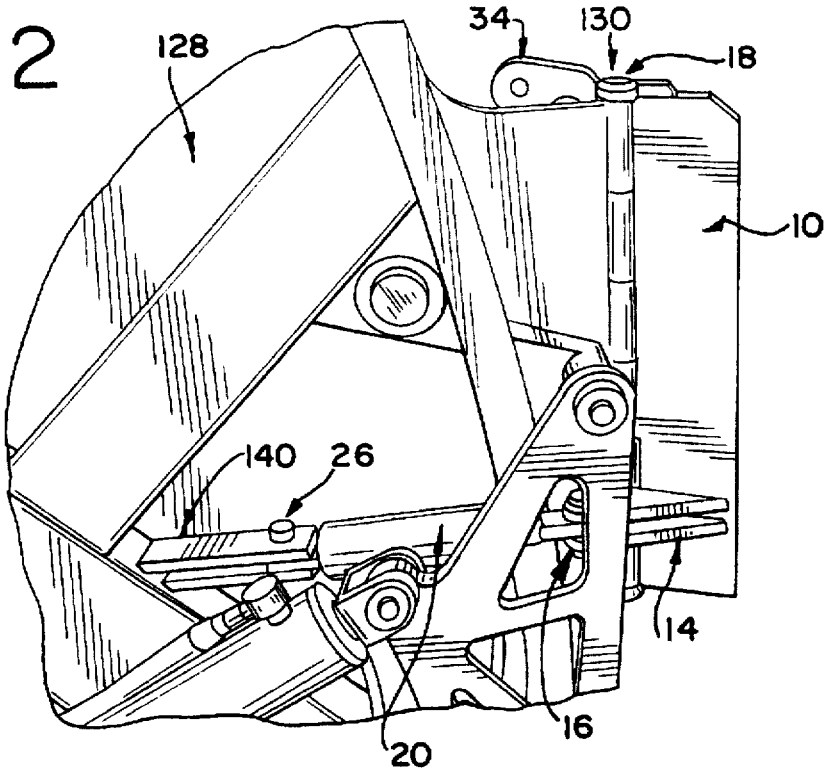
FIG. 2 is a side view of the rear portion of the refuse collection vehicle, showing the latch in the open position.
Figure 4:
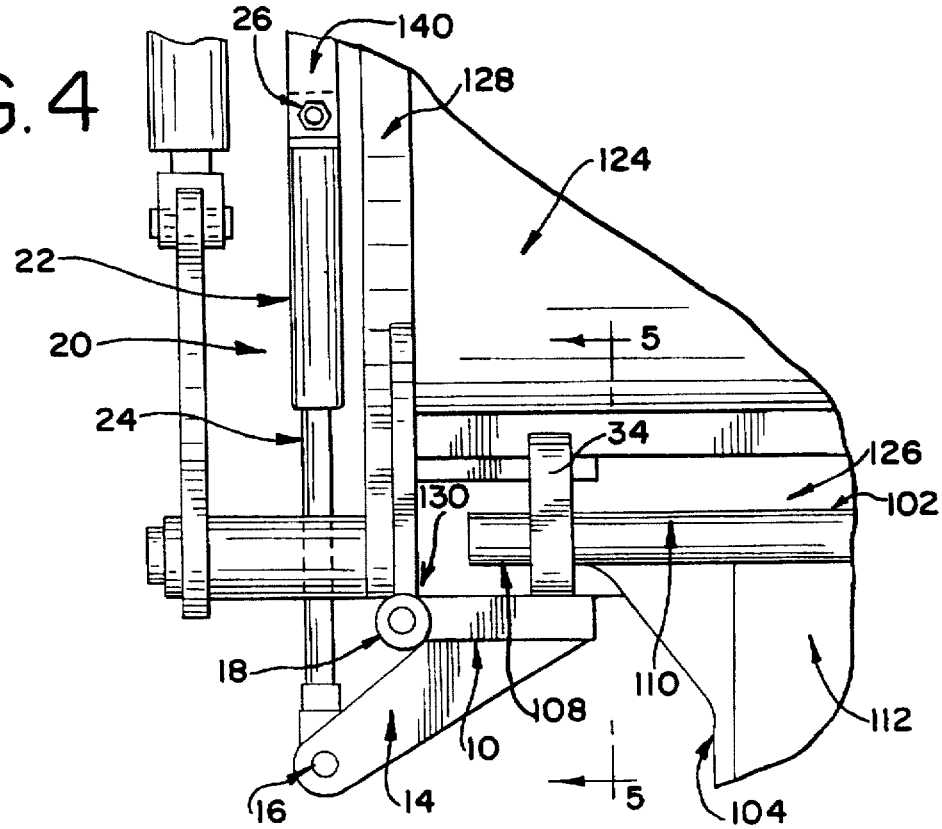
FIG. 4 is a view of the rear portion of the refuse collection vehicle from above, showing the latch in the closed position.

As shown in FIGS. 2, 3 and 4, two triangular plates 14 are mounted on the outer surfaces of latch plates 10. Triangular plates 14 are spaced apart so as to allow one end of a power supply, in the form of a hydraulic piston-cylinder arrangement 20, to be attached to latch plate 10 by means of a pin 16, or other fastening device. The other end of piston-cylinder arrangement 20 is attached between two spaced rectangular plates 140 by means of a second pin 26, or other fastening device. Rectangular plates 140 are attached to side 128 of vehicle 120 by means such as welding, for example.

Alternatively, triangular plates 14 could be mounted on the lower inner face of latch plates 10, with pin 16, which attaches triangular plates 14 to piston-cylinder arrangements 20, located below sill 126. In this alternative embodiment, piston-cylinder arrangements 20 would be mounted to vehicle 120 under sill 126 and pistons 24 would extend outwardly. Despite the change in orientation, this alternative embodiment would function in much the same manner as the latch shown in FIG. 1, i.e., the extension of piston 24 would rotate latch plate 10 to the closed position, while retraction of piston 24 would rotate latch plate 10 to the open position.

While the power supply for use with the invention is preferably the hydraulic piston-cylinder arrangement, a number of different power supplies may be substituted, with appropriate modification of the attachment to the latch plate. By way of example, a rotary hydraulic cylinder or rotary motor could be used with the reconfiguration of hinge 18.

Near the top edge of each support plate 30 is mounted an upper stop 34. Upper stop 34 prevents continued motion upwards along support plate 30 in the vertical direction in the same manner that sill 126 prevents further motion downwards in the vertical direction.

Operation

In operation, latch plates 10 will rotate between the open position and the closed position, thereby defining an angular range of motion. This angular range of motion of latch plates 10 is defined as the rotational reach of latch plates 10.

Therefore, in operation, container 100 is first positioned with protrusions 108 within rotational reach of latch plates 10. However, it is not essential that protrusions 108 be placed in contact with support plates 30. Hydraulic piston-cylinder arrangements 20 are then activated. The extension of pistons 24 from cylinders 22 causes latch plates 10 to rotate about hinges 18.

As latch plates 10 rotate about hinges 18, the inner surfaces of latch plates 10 contact protrusions 108 of trunion bar 110 attached to container 100. In rotating between the open position and the closed position, latch plates 10 automatically draw container 100 up to and parallel with sill 126, thereby eliminating the need for manually positioning protrusions 108 directly against support plates 30. Furthermore, as shown in FIG. 4, hydraulic piston-cylinder arrangement 20 prevents the movement of container 100 away from vehicle 120 until is piston 24 retracted, causing latch plate 10 to rotate away from support plate 30.

Figure 5:
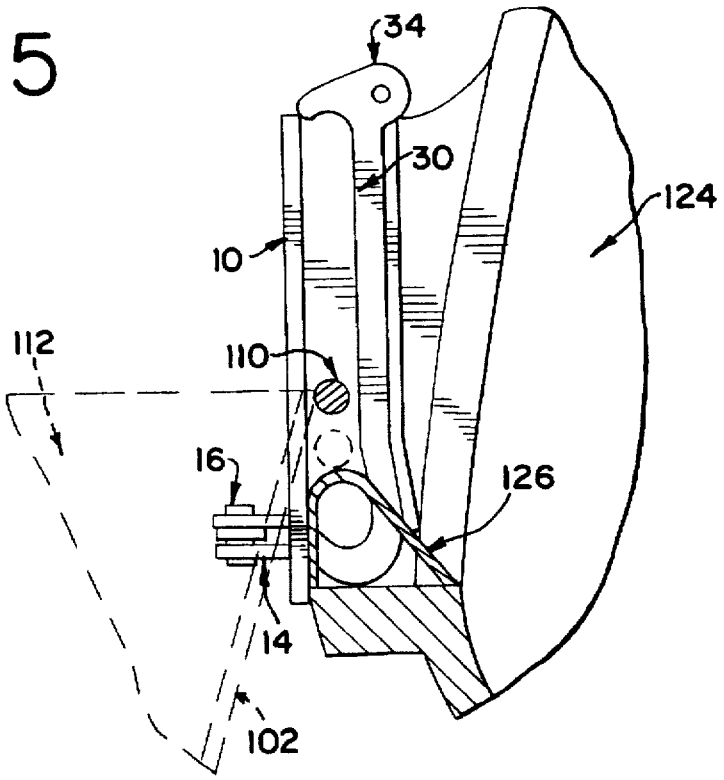
FIG. 5 is a side view of the rear portion of the refuse collection vehicle, showing the latch in the closed position.

To transfer the refuse from container 100 to vehicle 120, refuse container 100 is rotated into the transfer position through the use of a lifting device, for example, either a tipper bar 170 or a hoist, as are well known in the art. During this step of the procedure, protrusions 108 of container 100 will travel downwards along the channel defined by latch plate 10 and support plate 30 until trunion bar 110 preferably comes to rest against sill 126 as shown in FIG. 5. At this point, container 100 will pivot at the sill-trunnion bar interface, until the proper angle is achieved to transfer the refuse from collection chamber 112 of container 100 to the collection chamber of vehicle 120.

As container 100 is lowered, protrusions 108 will return upwardly along the channel between latch plate 10 and support plate 30 until container 100 is returned to its initial position. Upper stop 34 prevents protrusions 108 from exiting the channel on their return trip along the channel. Once container 100 has been returned to its initial position, pistons 24 may be retracted, thereby rotating latch plates 10 to their open positions and releasing container 100.

While this invention has been described with reference to an illustrative embodiment, it will be understood that this description is not intended to be construed in a limiting sense. Various modifications of the illustrative embodiments, as well as those other embodiments, will become apparent to those skilled in the art upon reference to this description. The invention is intended to be sent forth in the following claims.

I claim:

1. A refuse container latch for use with a refuse container having outwardly extending protrusions, the latch comprising:

a support surface mountable in an operable position on a refuse collection vehicle wherein the support surface extends in a vertical direction;

a latch surface, mountable in an operable position on a refuse collection vehicle wherein the latch surface is pivotable around a vertically extending axis between an open position and a closed position, said latch surface in the closed position being substantially vertical and facing said support surface to define a channel therebetween; and a power supply mountable on a refuse collection vehicle and operable to rotate said latch surface between the open position and the closed position, wherein with a refuse container in a pickup position, outwardly extending protrusions of a refuse container are confined to the channel defined between said latch surface and said support surface, the channel preventing substantial movement of the protrusions in a horizontal direction while allowing movement of the protrusions in a vertical direction.

2. The latch according to claim 1, said power supply further comprising a piston-cylinder arrangement, attached at one end to said latch surface and mountable at the other end on a refuse collection vehicle.

3. The latch according to claim 1, further comprising a sill surface, said sill surface defining a lower boundary to the channel defined between said support surface and said latch surface.

4. The latch according to claim 3, further comprising a stop surface, said stop surface defining an upper boundary to the channel defined between said support surface and said latch surface.

* * * * *